US007523749B2

(12) United States Patent
Lee et al.

(10) Patent No.: US 7,523,749 B2
(45) Date of Patent: Apr. 28, 2009

(54) VALVE ASSEMBLY FOR PNEUMATIC GUNS

(76) Inventors: Yi Kuan Lee, No. 113, Lane 60, Gong-Jiew Street, Ta-Li City, Taichung County (TW) 412; Hsiu-Chiang Chen, No. 113, Lane 60, Gong-Jiew Street, Ta-Li City, Taichung County (TW) 412

( * ) Notice: Subject to any disclaimer, the term of this patent is extended or adjusted under 35 U.S.C. 154(b) by 0 days.

(21) Appl. No.: 11/415,921

(22) Filed: May 1, 2006

(65) Prior Publication Data

US 2007/0251514 A1 Nov. 1, 2007

(51) Int. Cl.
*F41B 11/00* (2006.01)

(52) U.S. Cl. ..... 124/73

(58) Field of Classification Search ..... 124/70–77; 227/8, 9, 130, 136; 123/46
See application file for complete search history.

(56) References Cited

U.S. PATENT DOCUMENTS

2006/0225718 A1* 10/2006 Kirwan ..... 124/71
2007/0113836 A1* 5/2007 Dobbins ..... 124/73

* cited by examiner

*Primary Examiner*—Troy Chambers

(57) ABSTRACT

A pneumatic gun includes a barrel with a piston unit movably received therein and a handle is connected to the barrel. A chamber, an inlet passage, a communication path, a release path and a free area between the communication path and the release path are defined in the handle. An inlet is defined between the inlet passage and the free area. A neck opening is defined between the chamber and the free area. The communication path communicates with the interior, and the release path communicates with the chamber. A valve unit is received in the chamber and includes a movable part which is reciprocally movable in the inlet, free area and the chamber. A distal end of the movable part is located not below a lowest periphery of the inlet when the valve unit is activated by pulling the trigger.

3 Claims, 5 Drawing Sheets

PRIORT ART

PRIORT ART

PRIORT ART

PRIORT ART

VALVE ASSEMBLY FOR PNEUMATIC GUNS

FIELD OF THE INVENTION

The present invention relates to a valve assembly received in the handle and the volume of air entering the barrel is controlled to protect the piston unit in the barrel.

BACKGROUND OF THE INVENTION

A conventional pneumatic gun is shown in FIGS. 1 to 4 and generally includes a barrel having an interior 14 and a piston unit 2 is movably received in the interior 14. A handle 1 is connected to the barrel and an inlet passage 10, a communication path 11, a release path 12, a chamber 13 and a free area 15 between the release path 12 an the chamber 13 are respectively defined. An inlet 16 is defined between the inlet passage 10 and the free area 15, and a neck opening 18 is defined between the chamber 13 and the free area 15. The communication path 11 and the interior 14 are in communication with each other so as to introduce air into the interior 14 to move the piston unit 2. A valve unit 3 includes a movable part 30, a piston member 31 and a seat 32 which is located at an end of the chamber 13. An end of the movable part 30 and the piston member 31 are located between the seat 32 and the chamber 13. An end of the piston member 31 protrudes out from the seat 32 and is located on the path of the movement of the trigger 4. The movable part 30 can be moved in the inlet 16, the free area 15 and the chamber 13. Two seals 35, 36 are connected on the movable part 30 and the movable part 30 is movable relative to the piston member 31.

When pulling the trigger 4, the piston member 31 is pushed upward as disclosed in FIG. 2 till the seal 37 seals the path of the movable part 30 to stop the air entering the chamber 13. The air in the chamber 13 releases from the gaps between the piston member 31 and the seat 32, and this forms a lower pressure area in the lower portion of the chamber 13 so that the movable member 30 is quickly moved downward till the seal 35 seals the neck opening 18 as shown in FIG. 3. The air is then allowed to enter the interior 14 via the inlet 16 and the communication path 11 to move the piston unit 2 to shoot a nail or a staple which is not shown.

It is noted that when shooting, the top end of the movable member 30 is located below the lowest periphery of the inlet 16 so that the inlet 16 is completely opened so that the air can enter the interior at a large volume to move the piston unit 2 at high speed. Nevertheless, the piston unit 2 moves so fast that the impact needle, the cushion pad, the piston and other parts of the piston unit 2 are easily damaged.

The present invention intends to provide a valve assembly for controlling the volume of air entering the interior of the barrel so as to protect the parts of the piston unit when shooting.

SUMMARY OF THE INVENTION

The present invention relates to a pneumatic gun that comprises a barrel with an interior defined therein and a piston unit is movably received in the interior. A handle is connected to the barrel and has a chamber, an inlet passage, a communication path, a release path and a free area defined between the communication path and the release path. An inlet is defined between the inlet passage and the free area, and a neck opening is defined between the chamber and the free area. The communication path communicates with the interior and the release path communicates with the chamber. A valve unit has a movable part which is reciprocally movable in the inlet, the free area and the chamber. The distal end of the movable part is located not below a lowest periphery of the inlet when the valve unit is activated.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 2:
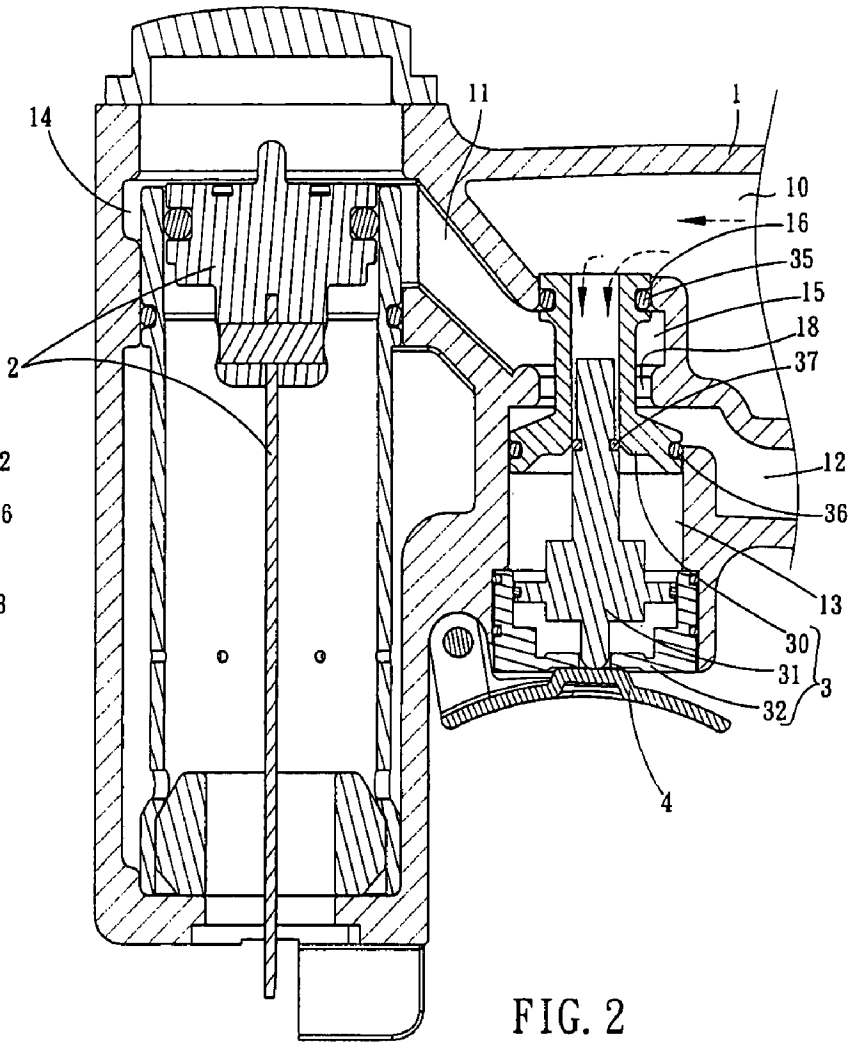
FIG. 2 shows the trigger of the conventional pneumatic gun is pulled while the valve unit is not yet completely operated.
Figure 1:
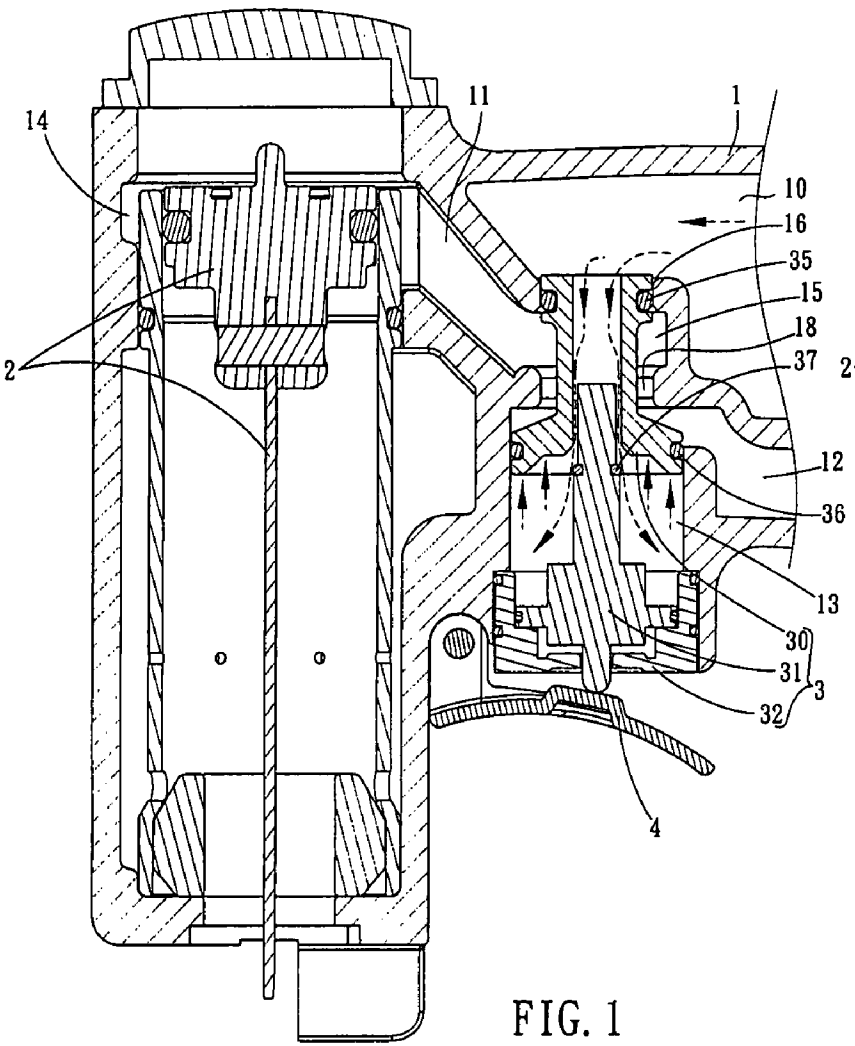
FIG. 1 shows a conventional pneumatic gun.
Figure 4:
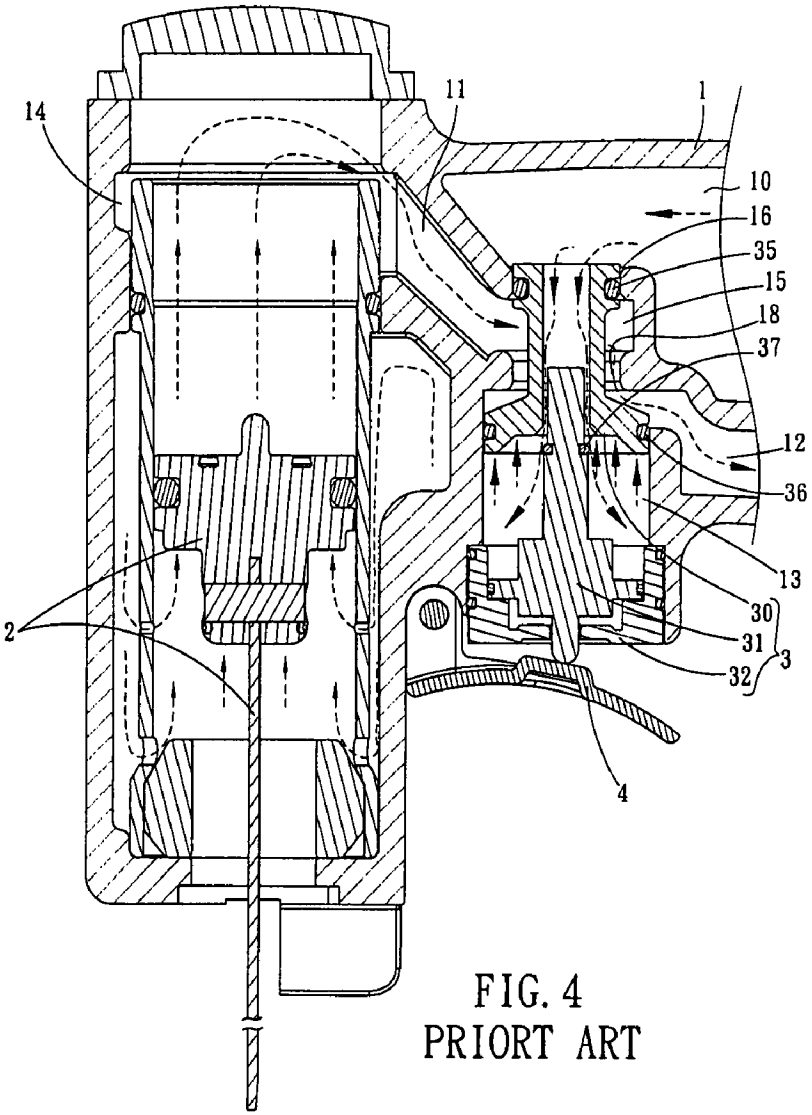
FIG. 4 shows the trigger of the conventional pneumatic gun is released.
Figure 3:
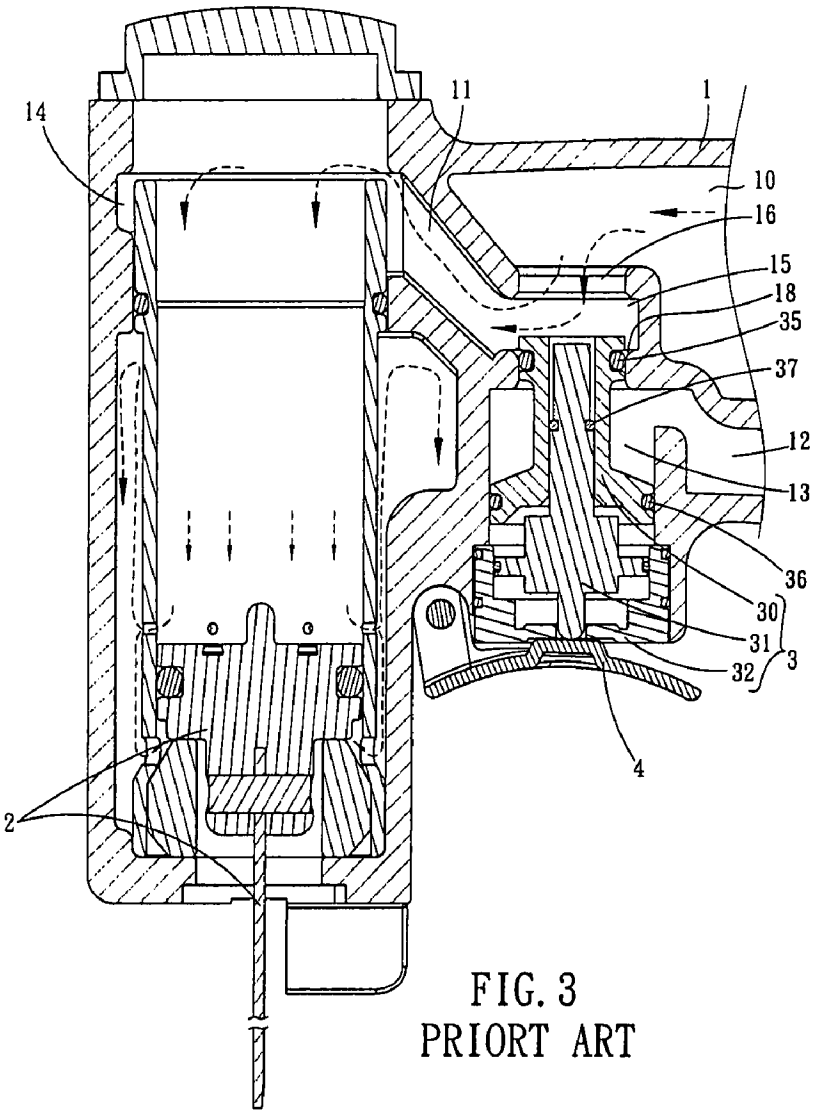
FIG. 3 shows the movable member of the valve unit of the conventional pneumatic gun is moved to allow air to enter into the interior of the barrel.
Figure 6:
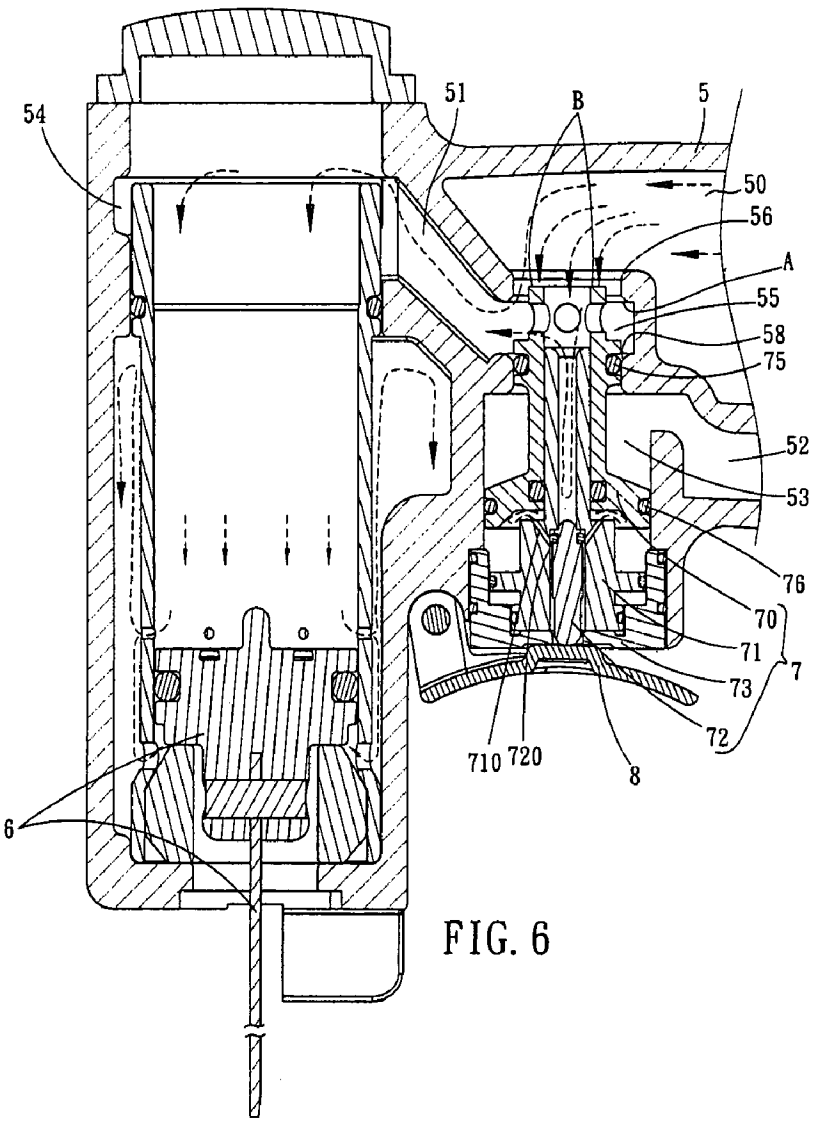
FIG. 6 shows that the trigger is pulled and the piston unit in the barrel is moved.
Figure 5:
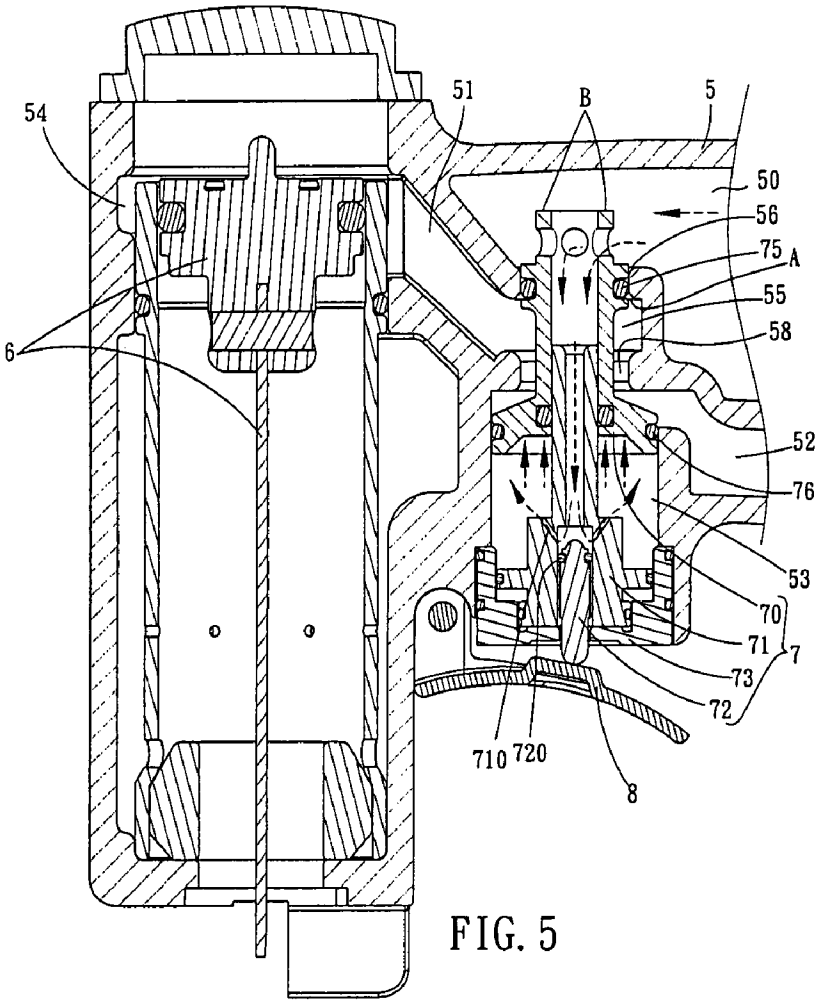
FIG. 5 shows the pneumatic gun of the present invention.
Figure 7:
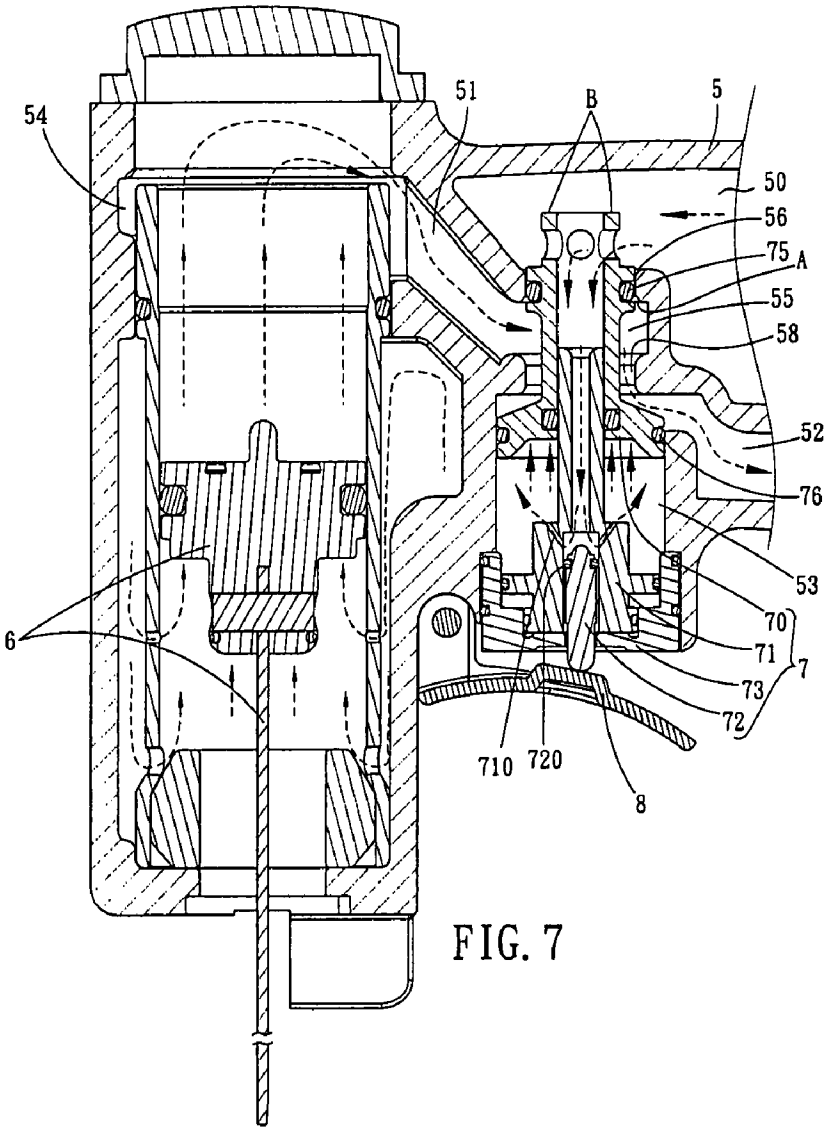
FIG. 7 shows that the trigger is released after shooting.

Referring to FIGS. 5 to 7, the pneumatic gun of the present invention comprises a barrel with an interior 54 defined therein and a piston unit 6 is movably received in the interior 54. A handle 5 is connected to the barrel and has a chamber 53, an inlet passage 50, a communication path 51, a release path 52 and a free area 55 defined between the communication path 51 and the release path 52. An inlet 56 is defined between the inlet passage 50 and the free area 55, and a neck opening 58 is defined between the chamber 53 and the free area 55. The communication path 51 communicates with the interior 54 so that air can be introduced into the interior via the communication path 51. The release path 52 communicates with the chamber 53.

A valve unit 7 is received in the handle 5 and includes a movable part 70, a piston member 71, a control member 72 and a seat 73. The movable part 70 is a hollow member and mounted on the hollow piston member 71 which includes two guide holes 710. The movable part 70 is reciprocally movable in the inlet 56, the free area 55 and the chamber 53. The seat 73 is located in the chamber 53, and an end of the movable part 70, the piston member 71 and the control member 72 are movable between the seat 73 and the chamber 53. The movable part 70 is movable relative to the piston member 71, and the piston member 71 is movable relative to the control member 72. Two seals 75, 76 are mounted to the movable part 70 so as to removably seal the inlet 56 and the neck opening 58. An end of the control member 72 protrudes out from the seat 73 and is located on a path of movement of the trigger 8. A distal end "B" of the movable part 70 is located not below a lowest periphery of the inlet 56 when the valve unit 7 is activated by pulling the trigger 8.

When pulling the trigger 8, the control member 72 is pushed upward (FIG. 6) till the seal 720 on the control member 72 moves over the guide holes 710 and seals the inlet of the control member 72 to stop the air from entering the chamber 53 from the inlet passage 50. The air escapes from the gaps between the piston member 71, and control member 72 and gaps between the control member 72 and the seat 73, this makes the pressure in the lower portion of the chamber 53 to be lower than that pressure in the inlet passage 50 so that the seal 75 on the movable part 70 an the movable part 70 are moved downward till the seal 75 seals the neck opening 58 as shown in FIG. 6. Because the distal end "B" of the movable part 70 is located not below the lowest periphery of the inlet 56, the distal end "B" of the movable part 70 is located in the inlet 56 so as to limit the volume of air entering the interior 54. In other words, the piston unit 6 is pushed by the limited volume of air which is sufficient to move the piston unit 6, while the speed of the piston unit 6 is not too fast to damage the parts composed of the piston unit 6.

Figure 8:
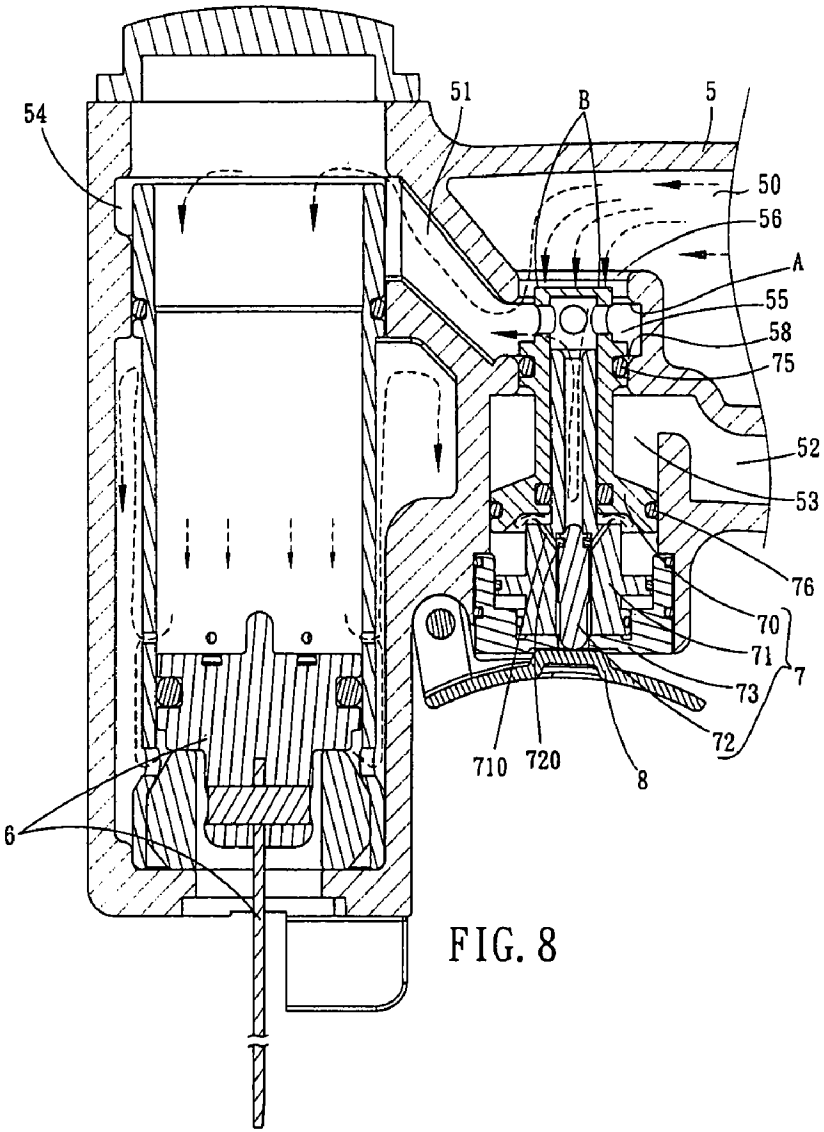
FIG. 8 shows another embodiment of the valve unit and the trigger is pulled.

FIG. 8 shows another embodiment of the present invention wherein the main difference is that the movable member 70 has a closed distal end "B" which is located in the inlet 56 when shooting.

Figure 9:
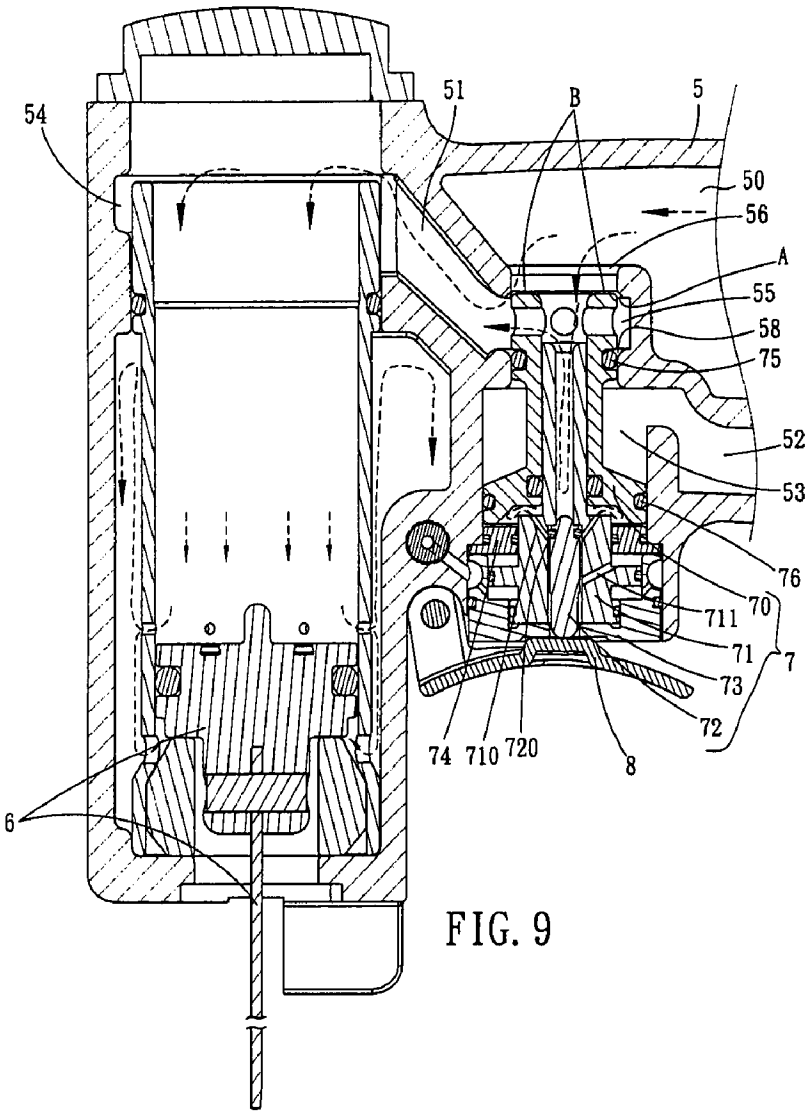
FIG. 9 shows yet another embodiment of the valve unit and the trigger is pulled.

FIG. 9 shows yet another embodiment of the present invention, wherein the main difference is that the valve unit 7 includes the movable part 70, a piston member 71, a control member 72, a seat 73 and a separation member 74. The separation member 74 is located in the chamber 53 and defines the chamber 53 into an upper space and a lower space. The movable part 70 is movable between the inlet 56 and the upper space, and the piston member 71 is movable between the lower space and the seat 73. An end of the piston member 71 extends through the separation member 74 and is located in the hollow movable part 70. The hollow piston member 71 includes guide holes 710, 711 which are in communication with the upper space of the chamber 53 and the lower space of the chamber 53. A seal 720 on the control member 72 removably seals the hollow piston member 71 to allow the hollow piston member 71 and the movable part 70 to move.

While we have shown and described the embodiment in accordance with the present invention, it should be clear to those skilled in the art that further embodiments may be made without departing from the scope of the present invention.

What is claimed is:

1. A pneumatic gun comprising:

a barrel with an interior defined therein and a piston unit movably received in the interior, a handle connected to the barrel and having a chamber, an inlet passage, a communication path, a release path and a free area defined between the communication path and the release path, an inlet defined between the inlet passage and the free area, a neck opening defined between the chamber and the free area, the communication path communicating with the interior, the release path communicating with the chamber, and a valve unit having a movable part, a piston member, a control member, a seat and a separation member, the movable part being reciprocally movable in the inlet, the free area and the chamber, a distal end of the movable part located not below a lowest periphery of the inlet when the valve unit is activated, the separation member located in the chamber and defining the chamber into an upper space and a lower space, the movable part movable between the inlet and the upper space, the piston member movable between the lower space and the seat, an end of the piston member extending through the separation member and located in the movable part, the piston member including guide holes which are in communication with the upper space of the chamber and the lower space of the chamber, a seal on the control member removably sealing the piston member to allow the piston member and the movable part to move.

2. The pneumatic gun as claimed in claim 1, wherein the valve unit includes the movable part, a piston member, a control member and a seat, the seat is located in the chamber, an end of the movable part, the piston member and the control member are movable between the seat and the chamber, the movable part is movable relative to the piston member, the piston member being movable relative to the control member, an end of the control member protrudes out from the seat and is located on a path of movement of the trigger.

3. The pneumatic gun as claimed in claim 2, wherein the movable part is a hollow member and mounted on the piston member, two seals are mounted to the movable part so as to removably seal the inlet and the neck opening.

* * * * *